US007938370B1

(12) United States Patent
Lechevin et al.

(10) Patent No.: US 7,938,370 B1
(45) Date of Patent: May 10, 2011

(54) METHOD FOR MEASURING THE SPEED OF A RAIL VEHICLE AND INSTALLATION THEREFOR

(75) Inventors: Eric Lechevin, Leuze-En-Hainaut (BE); Jean-Pierre Franckart, Montignies-Sur-Sambre (BE); Danièle Galardini, Monceau-Sur-Sambre (BE)

(73) Assignee: Alstom Belgium S.A., Charleroi (BG)

( * ) Notice: Subject to any disclaimer, the term of this patent is extended or adjusted under 35 U.S.C. 154(b) by 0 days.

(21) Appl. No.: 10/031,274

(22) PCT Filed: Apr. 20, 2000

(86) PCT No.: PCT/BE00/00043

§ 371 (c)(1),
(2), (4) Date: Jun. 11, 2002

(87) PCT Pub. No.: WO00/66412

PCT Pub. Date: Nov. 9, 2000

(30) Foreign Application Priority Data

Apr. 30, 1999 (EP) ..... 99870079

(51) Int. Cl.
*B61L 3/00* (2006.01)

(52) U.S. Cl. ... 246/34 R; 246/177; 246/178; 246/182 R; 246/249; 246/246; 246/255; 324/160; 324/173; 324/179

(58) Field of Classification Search ..... 246/34 R, 246/34 A, 34 B, 41, 62, 63 R, 88, 122 R, 246/167 R, 177, 178, 179, 182 R, 182 C, 246/201, 202, 255, 246; 324/160, 173, 179; 340/441; 702/142, 141
See application file for complete search history.

(56) References Cited

U.S. PATENT DOCUMENTS 4,270,716 A * 6/1981 Anderson ..... 246/182 B

FOREIGN PATENT DOCUMENTS

GB 2 153 571 8/1985
WO WO 97/12796 4/1997

OTHER PUBLICATIONS

EP 99870079.3, Apr. 30, 1999 (priority document).*

* cited by examiner

*Primary Examiner* — Mark T Le
(74) *Attorney, Agent, or Firm* — Knobbe Martens Olson & Bear LLP

(57) ABSTRACT

In order to measure a speed of a vehicle having an antenna and travelling on a track formed by two rails, first and second discontinuities are detected. The first discontinuity is detected in a current or voltage of a signal generated by an antenna when the vehicle passes a first tuning block of an electric joint. The second discontinuity is detected in a current or voltage of a signal generated by the antenna when the vehicle passes a second tuning block of the electric joint. The detected discontinuities are used to measure the speed of the vehicle travelling on a track divided in track sections separated by electric joints. Each electric joint includes two tuning blocks and a predetermined length of a track section, wherein each of the tuning blocks allows power coupling between adjacent track sections.

17 Claims, 5 Drawing Sheets

METHOD FOR MEASURING THE SPEED OF A RAIL VEHICLE AND INSTALLATION THEREFOR

BACKGROUND OF THE INVENTION

1. Field of the Invention

The present invention relates to a method for measuring the speed of a vehicle travelling on a track of railway type.

The present invention also relates to the installation for carrying out this method.

2. Description of the Related Art

Various systems for determining the speed of a train travelling on a track have already been proposed. In particular, it has been suggested to use a sensor present on an axle to determine the speed of the train travelling on the track. However, this speed is not always sufficiently precise, and in particular, it might not take account of a risk arising when the wheel skids for reasons such as the climatic conditions (frost or snow) or the presence of leaves on the rails.

It has also been proposed to place two or three sensors on different axles in order to obtain better precision. However, this remains insufficient from the point of view of the risk management.

It is also known practice to arrange beacons along railway tracks in order to measure the speed of the vehicle travelling on these tracks. In this case, beacons, which are arranged at known and fixed distances, emit a signal. The vehicle travelling close to this beacon detects, with the aid of an antenna, the passage over the first beacon and measures the time upto the passage of the second beacon. The speed is readily deduced from the known distance between the two beacons and the time taken by the vehicle to cover this distance. Nevertheless, the beacons are placed a relatively large distance apart and this amounts essentially to measuring the average speeds over the distance covered.

It has also been proposed in document WO97/12796 to use a calibrated beacon to determine the almost instantaneous speed of a vehicle passing in its vicinity. This beacon emits a magnetic field and, by means of an antenna placed under the vehicle, this vehicle can detect the entry into and exit from this field of magnetic influence. The time taken by the vehicle to cross the field of magnetic influence is deduced therefrom, and the speed of the vehicle is thus calculated. This method has the drawback of needing to place beacons at regular distances along the tracks.

Moreover, it is known practice to organize a track into track sections known as "block-sections", which are separated by electric joints. An electric joint consists of two tuning blocks acting as the power coupling for the track sections adjacent to each tuning block and for the short length of track located between these two tuning blocks (15 to 30 meters). Usually, the first tuning block acts as an emitter at a given frequency while the second tuning block acts as a receiver at another frequency. The functions of the electric joint are, firstly, to prevent the propagation of the signal from one track circuit to the adjacent track circuit and, secondly, to couple the emitter and the receiver with the track.

It is already known practice to use an electric joint to detect the passage of a train. Actually, on passage of the train axles, a short-circuit is created between the two rails via the train axles and thus enables the detection of the position of said train relative to the emitter from the change of current in the track. Specifically, it is observed that the current at the F1 frequency in the rail in front of the axle is high before the axle passes at the level of the emitter connection, and undergoes a strong discontinuity at the moment the axle passes.

The document GB-A-2 153 571 describes an example of a track circuit assembly that is particularly suitable for a short track circuit of less than 40 m in length, which may be used in underground railway transit systems.

It is mentioned therein that an electrical short-circuit is produced between the rails and that an AC signal control unit is connected approximately 6 meters later so as to tune the loop thus formed to the resonance, to the frequency of the selected track signal. The control units comprise a capacitor, the value of which is chosen so as to adjust the resonance, and a transformer, one coil of which is mounted in series with the capacitor, a track circuit signal emitter or receiver being connected via a second coil of the transformer.

SUMMARY OF THE INVENTION

The present invention aims to provide a solution which can offer the maximum security within the railway context of the term in measuring the speed of a vehicle travelling on a track of railway type.

More particularly, the present invention aims to propose a method which allows the average speed to be estimated independently of the error sources, due, for example, to skidding and to engagement of the axles, and which is based on the detection, when a train passes, of joints separating the various track circuits.

The present invention aims to propose a system which can dispense with the installation of beacons along the tracks.

More particularly, the present invention aims to use already existing train-locating equipment which consists of track circuits with electric joints.

The present invention relates to a method for measuring the speed of a vehicle provided with an antenna and travelling on a track with two rails in the form of track sections known as "block-sections" separated by electric joints, each electric joint consisting of two tuning blocks and of the predetermined track section located between them, each of the tuning blocks allowing the power coupling for the adjacent track section acting as a block-section, characterized in that at least two discontinuities are detected in the current or voltage of the signal as seen by an antenna which is present in the vehicle travelling on the track in the immediate vicinity of the first and second tuning blocks of the same electric joint, in order to measure the speed of the vehicle travelling on the track.

The first discontinuity is obtained when the axle passes at the level of the first tuning block for the frequency of this first tuning block.

The second discontinuity is obtained by exerting an electrical action at the frequency of the first tuning block. This second discontinuity is obtained by creating an electric or magnetic field in the area of the second tuning block. This electric or magnetic field is generated by means of a current which is proportional to the current emitted by the voltage injected into the first tuning block. This field is generated directly by the current emitted by said voltage.

According to another embodiment, the electrical action is a voltage injected in series with the voltage at the second frequency of the second tuning block. This voltage injected in series is proportional to that which is injected into the first tuning block.

According to another embodiment, the electrical action is the injection of a current into a voltage generator which is present in the second tuning block, this current travelling round a loop arranged between the rails, said current being proportional to the current emitted by the voltage injected into the first tuning block.

The signal detected by the antenna which is on board the vehicle travelling on the track is filtered at the frequency of the voltage injected into the first tuning block.

The present invention also relates to an installation for carrying out the method as described above, in which the track is organized in the form of block-sections separated by electric joints, each electric joint consisting of at least two tuning blocks and of the short track section located between them. This installation comprises means for generating at least two current or voltage discontinuities in the signal as seen by the antenna which is present in the vehicle travelling on the track in the immediate vicinity of the first and second tuning blocks of the same electric joint.

DETAILED DESCRIPTION OF THE PREFERRED EMBODIMENT

Figure 1:
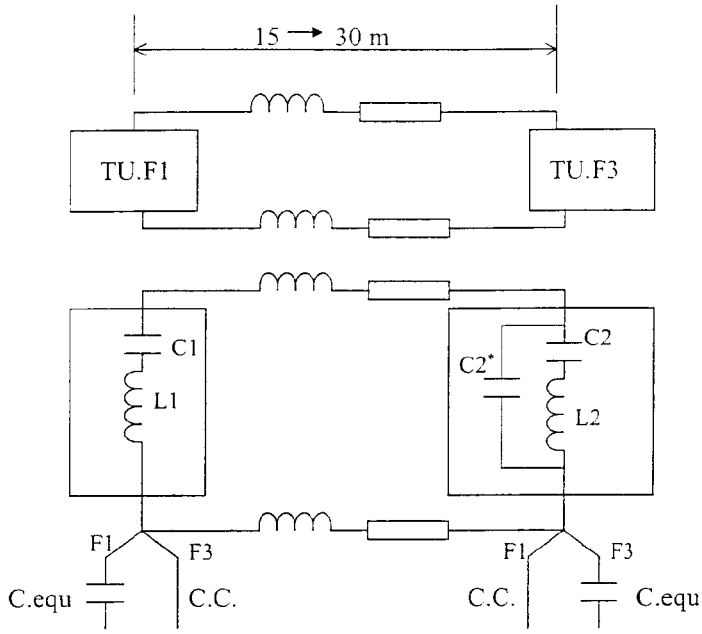
Figure 1 (Prior Art)
FIG. 1 represents the electric diagram equivalent of an electric joint.

An electric joint as represented in FIG. 1 comprises a first tuning block TU.F1 located on a first side (left), which will serve as an emitter in order to generate a voltage in the track at the frequency F1 and allows the power coupling of this first side (left) of the track adjacent to the tuning block. A second tuning block TU.F3, located at a distance of 15 to 30 meters, allows the power coupling of the other part of the track (right) adjacent to this tuning block. This second tuning block serves as a receiver for a frequency F3. It might optionally also act as an emitter, which would allow a voltage to be generated at the frequency F3.

Figure 2:
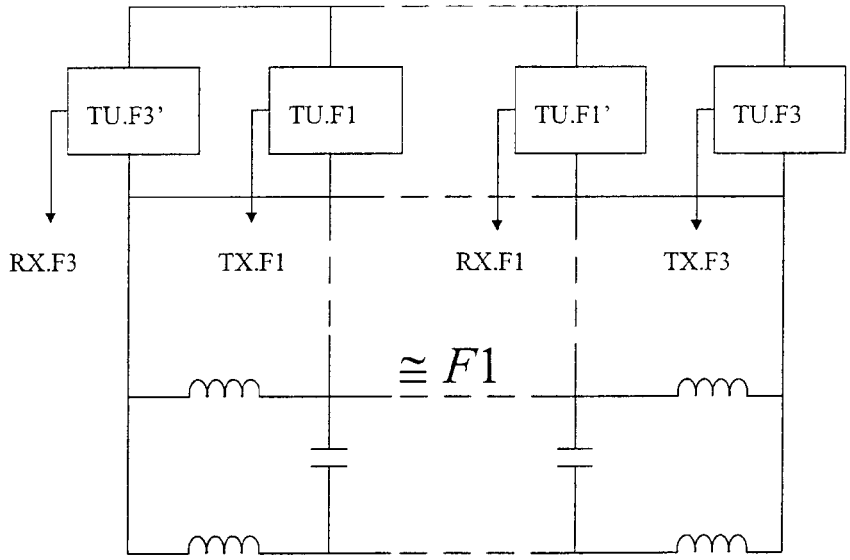
Figure 2 (Prior Art)
FIG. 2 represents the equivalent diagram of a track circuit between two electric joints as described in FIG. 1.

FIG. 2 represents a track circuit comprising several track sections organized into block-sections and separated by electric joints, each consisting of two tuning blocks coupled in pairs. For a frequency F1, the two tuning blocks TU.F1 and TU.F1' are equivalent to a capacity which performs the tuning of the track section (block-section 1) comprised between these two blocks, while the two tuning blocks TU.F3 and TU.F3' are equivalent to short-circuits at this same frequency (F1). At the frequency (F3) of the adjacent track circuits, the function of the tuning blocks is then inverted.

Figure 3:
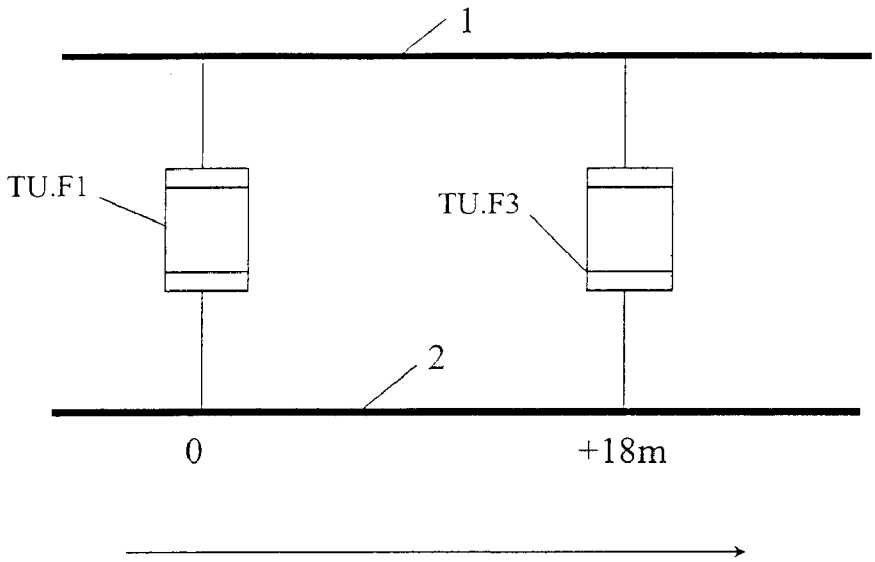
Figure 3 (Prior Art)
FIG. 3 indicates the effect of the axles on the current in the rails in front of the axles before the axle passes.
Figure 4:
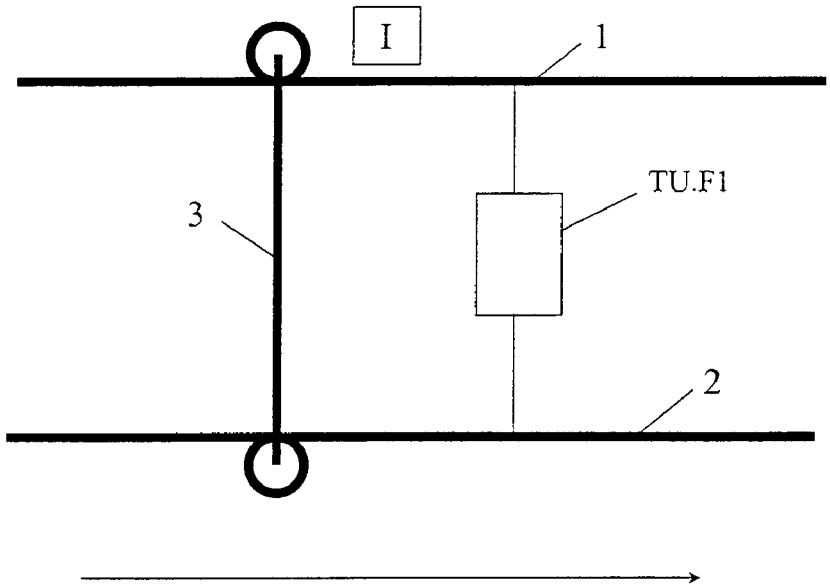
Figure 4 (Prior Art)
FIG. 4 indicates the effect of the axles on the current in the rails after the axle passes.

As represented in FIGS. 3 and 4, a shunt or short-circuit is created between the rails 1 and 2 when the axle 3 passes. More specifically, the behaviour of the current I generated at the frequency F1 and present in the track 1 in front of the axle 3 is modified.

Figure 5:
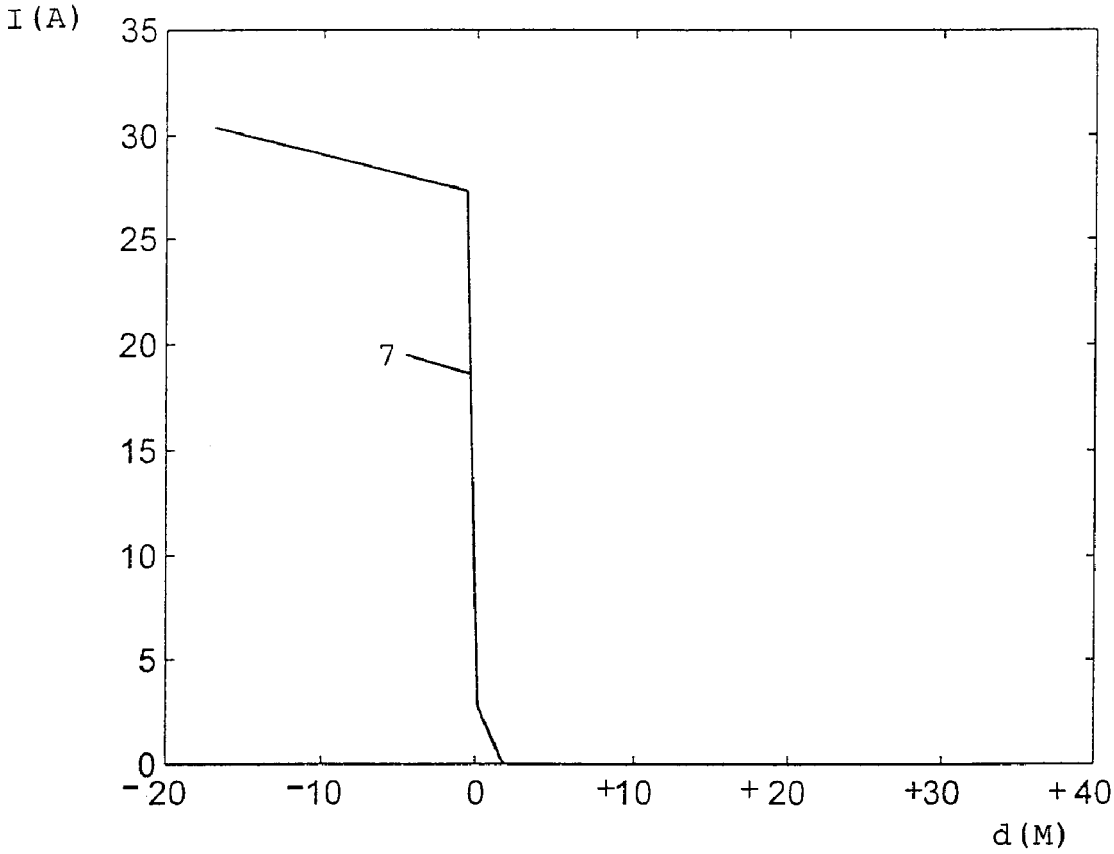
Figure 5 (Prior Art)
FIG. 5 represents the diagram of the current in the rails in front of the axles according to the prior art.

As shown in FIG. 5, it is observed that the current I at the frequency F1 remains high up to the moment at which the axle approaches the emitter TU.F1 which generates the signal at the frequency F1. At the level of said emitter, it is observed that the current I at the frequency F1 falls suddenly, creating a first discontinuity 7 at that point. FIG. 5 shows in details the behaviour of the current I in front of the axle, taking into account the position of the emitter TU.F1 on the x-axis serving as reference, whereas TU.F3 is situated at 18 m.

The present invention consists in creating a second discontinuity 8 in the immediate vicinity of the second tuning block TU.F3 and in using these two discontinuities occurring at a known distance in order to be able to calculate the average speed of the train between the two positions at which said discontinuities occur.

To this end, it is envisaged to detect on board the train a signal resulting from the magnetic field generated by the current I. More specifically, the voltage V obtained by filtering the antenna signals in a known manner will be proportional to the current I present in the rails in front of the axle 3. This signal is caught by at least one antenna of known type arranged upstream the first axle 3. The signal is filtered at the frequency F1 in order to allow the detection of the two discontinuities 7 and 8 of the current I. One or more other signals at the frequency F3 or at other frequencies may also be used for detecting other pairs of discontinuities occurring on other track circuits.

Figure 6:
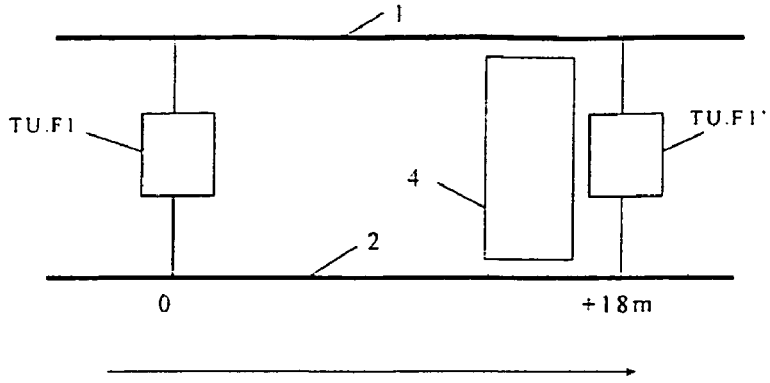
FIGS. 6, 7 and 8 represent several different embodiments of the invention.
Figure 7:
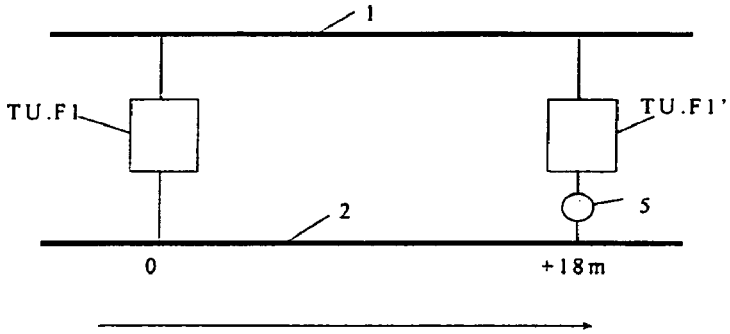

According to a first embodiment of the present invention, which is more particularly represented in FIG. 6, it is suggested to arrange a loop 4 between the rails 1 and 2 close to the block TU.F3 acting as receiver and equivalent to a short-circuit at the frequency F3. This loop 4 is supplied with a current at the frequency F1 which is preferably proportional to the current in the block TU.F1. It is preferably connected in series with this block. Advantageously, the magnetic field generated by the loop 4 creates the second discontinuity 8 required to carry out the method according to the present invention. According to another preferred embodiment of the invention, which is more particularly represented in FIG. 7, it is proposed to connect a voltage generator 5 at the frequency F1 in series with the block TU.F3. In this case, the block TU.F3 is equivalent to a short-circuit for the frequency F1. The generator 5 is preferably supplied from the power supply for the block TU.F1.

The second discontinuity 8 will be obtained during passage at the block TU.F3 (x-axis=18 m), the voltage being proportional to that of the block TU.F1 (emitter at the frequency F1).

Figure 8:
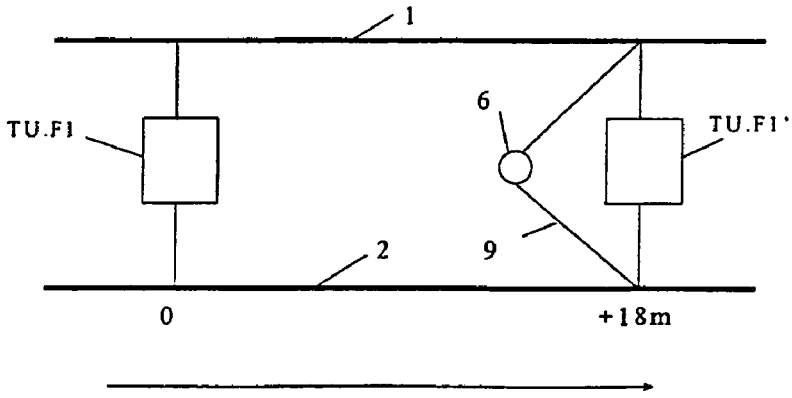

According to another embodiment, represented in FIG. 8, a current generator 6 is connected in parallel to the terminals of the block TU.F3. The current thus generated travels round the loop 9 arranged between the two rails 1 and 2, thus creating a magnetic field that is detectable at that point. The generator 6 at the frequency F1 is advantageously arranged in series with the block TU.F1 and thus creates the second desired discontinuity 8.

Figure 9:
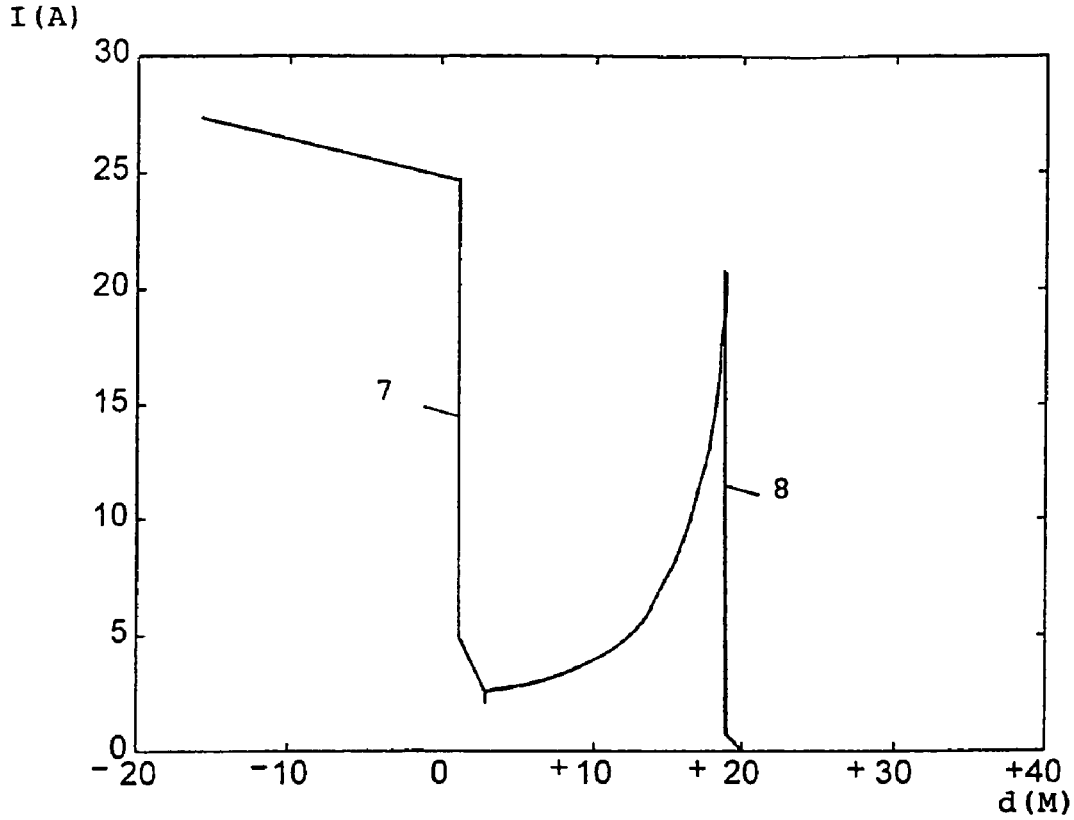
FIG. 9 represents the diagram of the current in the rails in front of the axle according to the invention.

FIG. 9 shows the current I as a function of the distance traveled on the rails by positioning the block TU.F1 creating the first discontinuity at 0 and the block TU.F3 creating the second discontinuity at 18 m. One may detect a signal on board by filtering the antenna signals at the frequency F1 and detect the presence of the two discontinuities 7 and 8 whose descending slopes are linked to the precise position of the blocks TU.F1 and TU.F3.

Conventionally, the detection of these two detected discontinuities will be processed using a microprocessor, which makes it possible to define the time interval between the detection of said discontinuities. Conventionally, knowledge of the precise distance between the blocks TU.F1 and TU.F3 will make it possible to calculate the average speed of the vehicle travelling on said track between the two blocks TU.F1 and TU.F3.

In a particularly advantageous manner, it is observed that the cost of installation of the additional device is relatively low and thus makes it possible to obtain a relatively precise measurement of the speed of the train travelling on a track. In addition, the measurement of this speed remains independent of the precise positioning of beacons, for example, the movement of which might occur in the event of maintenance work on the track, climatic phenomena, skidding of the wheels, etc.

What is claimed is:

1. A method of measuring a speed of a vehicle having an antenna and travelling on a track formed by two rails, the track being divided in track sections separated by electric joints, each electric joint including two tuning blocks and a predetermined length of a track section, each of the tuning blocks allowing power coupling between adjacent track sections, the method comprising:

detecting a first discontinuity in a current or voltage of a signal generated by the antenna at a first predetermined frequency when the vehicle passes a first tuning block of an electric joint configured to operate at the same first frequency;

detecting a second discontinuity in a current or voltage of a signal generated by the antenna at the same first frequency when the vehicle passes a second tuning block of the electric joint configured to operate at a second predetermined frequency; and using the detected discontinuities to measure the speed of the vehicle travelling on the track.

2. The method of claim 1, further comprising obtaining the first discontinuity when an axle of the vehicle passes at a level of the first tuning block, wherein the first tuning block is configured to operate at the first frequency.

3. The method of claim 2, further comprising exerting an electrical action at the first frequency of the first tuning block to obtain the second discontinuity.

4. The method of claim 3, wherein the second discontinuity is obtained by creating an electric or magnetic field in a vicinity of the second tuning block.

5. The method of claim 4, wherein the electric or magnetic field is generated through a current which is proportional to a current caused by a voltage injected into the first tuning block.

6. The method of claim 5, wherein the electric or magnetic field is generated by the current caused by said voltage.

7. The method of claim 3, wherein the electrical action is a voltage injected in series with a voltage at a second frequency of the second tuning block.

8. The method of claim 7, wherein the voltage injected in series is proportional to the voltage that is injected into the first tuning block.

9. The method of claim 3, wherein the electrical action is the injection of a current into a voltage generator of the second tuning block, and wherein the current travels around a loop arranged between the rails.

10. The method of claim 9, wherein the current is proportional to the current caused by the voltage injected into the first tuning block.

11. The method of claim 10, further comprising filtering said signal at the first frequency of the voltage injected into the first tuning block.

12. An installation for measuring a speed of a vehicle having an antenna and travelling on a track formed by two rails, the track being divided in track sections separated by electric joints, comprising:

a first tuning block in an electric joint, the first tuning block being configured to be in communication at a first predetermined frequency with an antenna of the vehicle when the vehicle passes the first tuning block;

a second tuning block in the electric joint, the second tuning block being configured to be in communication at a second predetermined frequency with the antenna when the vehicle passes the second tuning block; and a generator configured to generate at least two current or voltage discontinuities in a signal generated by the antenna at the first frequency when passing the first and second tuning blocks of the electric joint.

13. The installation of claim 12, wherein the generator includes a loop arranged in proximity to the second tuning block, and a power supply for a current at the first frequency of the first tuning block.

14. The installation of claim 13, wherein the loop is arranged in series with the first tuning block.

15. The installation of claim 12, wherein the generator includes a voltage generator at the first frequency of the first tuning block connected in series with the second tuning block.

16. The installation of claim 12, wherein the generator includes of a current generator connected in parallel to the second tuning block via a loop arranged between the rails.

17. The installation of claim 12, wherein the antenna on board the vehicle is placed in front of a first axle of the vehicle along with a receiver circuit connected to the antenna and provided with a filter set at the first frequency.

* * * * *